United States Patent [19]

Finch

[11] 4,016,998

[45] Apr. 12, 1977

[54] DRINKING VESSEL

[76] Inventor: Leonard Finch, 8765 Tyrone Ave., Van Nuys, Calif. 91402

[22] Filed: Apr. 1, 1976

[21] Appl. No.: 672,674

[52] U.S. Cl. ..... 220/90.2; 215/1 A

[51] Int. Cl.[2] ..... A47G 19/22

[58] Field of Search ..... 215/1 A; 220/90.2, 90.4, 220/90.6; 222/468, 470–475, 481, 488

[56] References Cited

UNITED STATES PATENTS

| | | | |
|---|---|---|---|
| 293,190 | 2/1884 | Moore | 220/90.2 |
| 2,627,735 | 2/1953 | Dexter | 220/90.2 |
| 2,687,628 | 8/1954 | Cunningham | 220/90.6 X |
| 3,349,987 | 10/1967 | Weitzner | 215/1 A X |

FOREIGN PATENTS OR APPLICATIONS

| | | | |
|---|---|---|---|
| 258,588 | 4/1913 | Germany | 220/90.6 |
| 468,107 | 11/1928 | Germany | 222/481 |

*Primary Examiner*—Donald F. Norton
*Attorney, Agent, or Firm*—John J. Posta, Jr.

[57] ABSTRACT

The improved drinking vessel of the present invention features a container having an integral straw. The straw may be in a rib or protrusion extending from the exterior of the container, and preferably at an angle above the top of the main part of the container. Instead, the straw may be in a handle of the container. Such straw may comprise a single channel or a pair or more of said channels. In the latter event, the channels may terminate parallel each other but with their lower ends at different levels in the liquid-holding cavity of the container.

Moreover, the channels can merge to form a common channel. The channels can be disposed in the vessel handle, one channel terminating near the top of such cavity and acting as an overflow channel. A valve may also be fitted in the straw, such as in the overflow channel. Moreover, the container may include a full or partial lip extending inwardly from the periphery at the top thereof, particularly in the area adjacent the straw, so as to prevent liquid spillage during tilting of the container. The novel container is inexpensive, durable, efficient and affords greater convenience than conventional drinking vessels.

3 Claims, 5 Drawing Figures

DRINKING VESSEL

BACKGROUND OF THE INVENTION

1. Field of the Invention

The present invention generally relates to containers and more particularly to improved drinking vessels.

2. Prior Art

Conventional bowls, mugs, glasses, cups and the like, with or without handles, for use in drinking liquids, such as warm soups, beverages and the like have no built-in straws or other drinking aids. Instead, they must be gripped, their top edges placed at the lips and then tilted to cause the liquid contained therein to flow therefrom. When straws are desired to be used therewith, they must be separately provided. Since straws generally are of thin paper, they are easily damaged in storage, transportation and use and represent some expense. Nevertheless, straws are commonly used with certain types of beverages because they facilitate easy and rapid drinking, such as when the beverage contains ice, ice cream or other particles or lumps of solids.

Straws, however, represent a messy disposal problem after their use. Moreover, when they are used, the user frequently tilts the drinking vessel to better angle the straw and, in so doing, may inadvertently spill liquid or solids from the top of the vessel.

Accordingly, there is a need for an improved drinking vessel which will have the advantages of conventional drinking vessels when used with straws, but which will more readily prevent inadvertent liquid spillage during use of the vessel and will be more compact, inexpensive, neater and more convenient in use.

SUMMARY OF THE INVENTION

The foregoing needs are satisfied by the improved drinking vessel of the present invention. The vessel is substantially as set forth in the Abstract above. In this regard, the vessel includes a container with an open-topped liquid-holding cavity, and an integral straw extending between that cavity and the top of the container. The straw is thus convenient and permanent. It may have one or more channels entering the cavity at different levels. One of such channels can function as an overflow channel to prevent liquid spillage from the vessel. Moreover, a valve may be disposed in the straw so that it can be opened or closed by the user, as desired. An inwardly extending lip may also be disposed along a part or all of the periphery at the top of the container so as to partly cover the cavity and thereby prevent liquid spillage from the vessel. These features provide the vessel with a novel appearance and improved function. Further features of the invention are set forth in the following detailed description and accompanying drawings.

DRAWINGS

DETAILED DESCRIPTION

Figure 1:
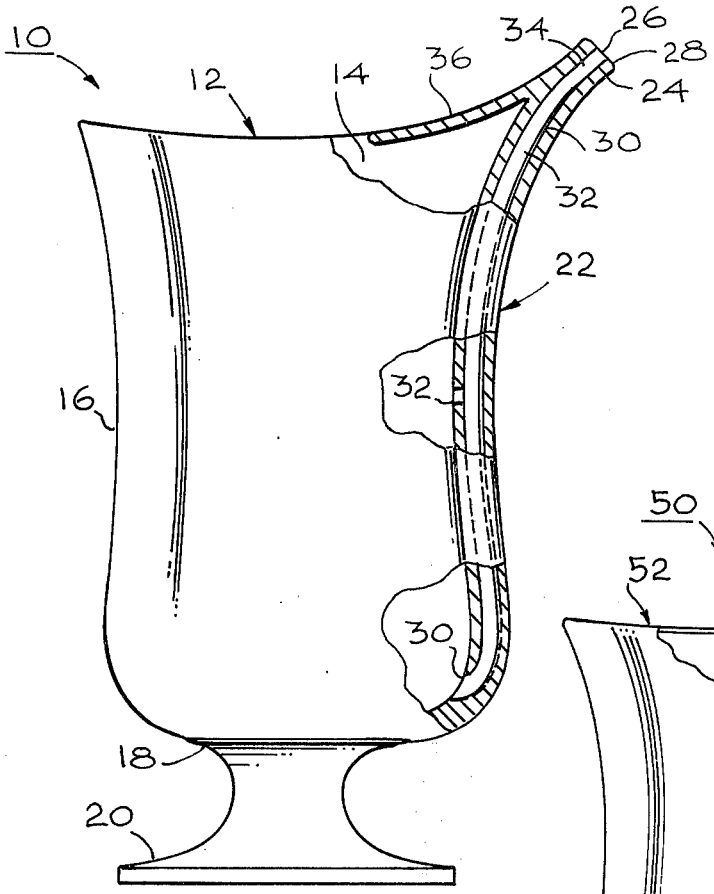
FIG. 1 is a schematic side elevation of a first preferred embodiment of the improved drinking vessel of the present invention, portions being broken away to illustrate certain internal features thereof.
Figure 2:
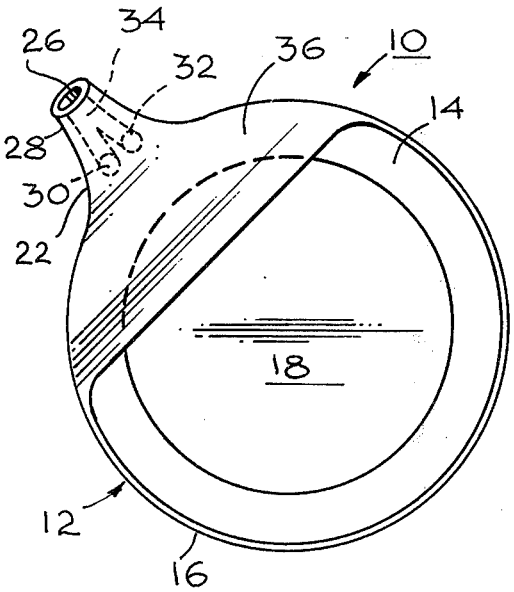
FIG. 2 is a schematic top plan view of the vessel of FIG. 1.

FIGS. 1 and 2

Now referring more particularly to FIGS. 1 and 2 of the accompanying drawings, a first preferred embodiment of the improved drinking vessel of the present invention is schematically set forth therein. Thus, a vessel 10 is shown which includes an open-topped vase-shaped container 12 having a central liquid-holding cavity 14 defined by integral curved sidewalls 16 and a bottom 18, the latter having a footed base 20.

Container 12 includes a generally vertically extending rib 22 projecting outwardly from sidewall 16 from about the bottom thereof to above the top 24 thereof and containing a double straw 26. The upper end 28 of straw 26 projects up at an angle away from container 12 to facilitate its use.

Straw 26 includes a pair of channels 30 and 32, the lower ends of which run into cavity 14 at different levels and the upper ends of which merge into a common channel 34 in the upper portion of rib 22. This construction permits straw 26 to be used even if there is a partial obstruction in either channel 30 or in channel 32, normally the construction simultaneously draws liquid from two levels in cavity 14 for maximum blending of liquid, very useful in situations where because of, for example, ice melting in cavity 14, the liquid in cavity 14 is not of uniform composition at different levels in cavity 14. It will be understood that, if desired, straw 26 can be of single channel construction.

Vessel 10 also includes an about horizontal lip 36 extending inwardly from the portion of the periphery at the top 24 of sidewall 16 which is adjacent straw 26. Lip 36 prevents inadvertent spillage of liquid (and/or entrained solids) from cavity 14 when container 12 is tilted during use of straw 26, particularly when cavity 14 is full or nearly full. While container 12 does not have to be tilted, due to the angle of the upper end 28 of straw 26, it usually is tilted for convenience at some stage of drinking from vessel 10 and still does not cause spillage such as frequently occurs when conventional straws are used with conventional drinking vessels. Since the tilting of vessel 10 is normally towards straw 26, lip 36 need only extend in that area, as shown in FIG. 2.

FIG. 3

Figure 3:
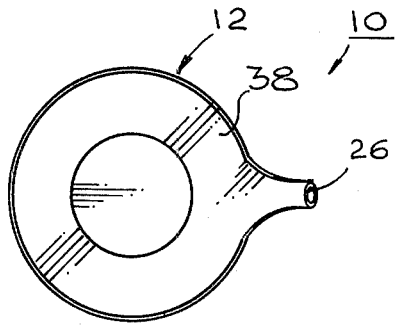
FIG. 3 is a schematic top plan view of a modified version of the vessel of FIG. 1, showing a full peripheral lip in place of the half lip of FIG. 2.

A modification of the structure in FIGS. 1 and 2 is shown in FIG. 3 in that a full generally horizontal lip 38 is shown disposed about the entire periphery at the top 24 of sidewall 16 so as to overlie cavity 14. Thus, with such an arrangement, container 12 can be tilted in any direction without spilling liquid from cavity 14.

Figure 4:
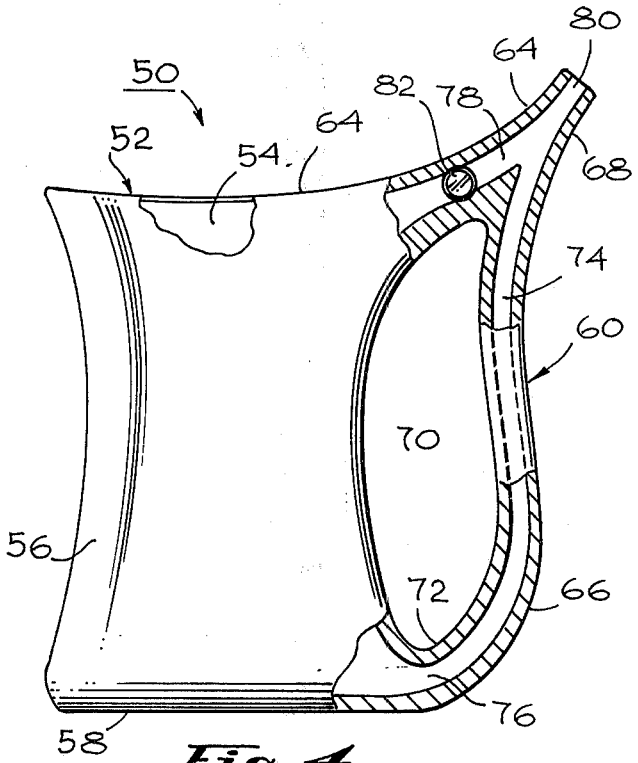
FIG. 4 is a schematic side elevation of a second preferred embodiment of the improved drinking vessel of the present invention, portions being broken away to illustrate certain internal features; and, FIG. 5 is a schematic top plan view of the vessel of FIG. 4.
Figure 5:
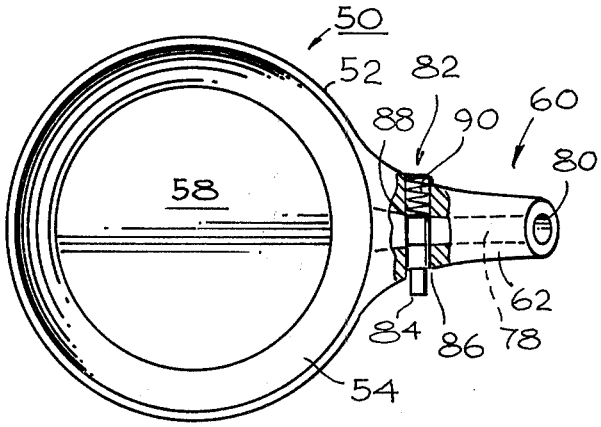

FIGS. 4 and 5

A second preferred embodiment of the improved drinking vessel of the present invention is schematically set forth in FIGS. 4 and 5. Thus, a vessel 50 is shown, which comprises a generally vase-shaped container 52 having an open-topped central liquid-holding cavity 54 defined by integral curved sidewalls 56 and flat bottom 58. Container 52 also includes a handle 60 having an upper portion 62 projecting upwardly and outwardly from the upper end 64 of sidewall 56 and a generally vertically extending portion 66 integral at its upper end 68 with portion 62, spaced lateral of sidewall 56 during most of its length so as to form a finger-receiving cavity 70 and with its lower end 72 terminating adjacent bottom 58, all as shown in FIG. 4.

Straw 74 is contained within handle 60 and comprises a pair of channels. Thus, it includes a channel 76, the lower end of which extends through end 72 of portion 66, then through sidewall 56 and into cavity 54, while the main body thereof is in portion 66 and the upper end thereof merges with laterally extending channel 78. Channel 78 is disposed in portion 62 and has its medial end pass through sidewall 56 and into cavity 54 adjacent the upper end thereof, while the distal end of channel 78 merges with channel 76, as described, to form a common channel 80 which terminates at the upper lateral (outer) tip of handle 60, as shown in FIG. 4.

Thus, channel 76 permits the user of vessel 50 to drain cavity 14 of liquid through channel 80, while channel 78 acts as an overflow tube, preventing inadvertent liquid spillage from cavity 54 when container 52 is tilted to facilitate use of straw 74. With such an arrangement, there is no need for a protective lip, such as lips 36 and 38. However, such a lip could be provided (not shown), if desired.

It is desirable to include a valve 82 in channel 78, as shown in FIGS. 4 and 5, so that channel 78 can be opened and closed, as desired. It will be understood that, if desired, a valve (not shown) can be placed in channels 76 and/or 80 and that such a valve could be used in channels 30, 32 and/or 34 of vessel 10. Valve 82 may be of any suitable construction, for example, a plunger 84 disposed in a transverse channel 86 in portion 62, extending outwardly therefrom and provided with a stop 88, a spring 90 biasing plunger 84 against stop 88 and a channel (not shown) alignable with channel 78 only when plunger 84 is depressed towards spring 90. Valve 82 may be conveniently positioned so as to be operable with the thumb or finger of the user's vessel-holding hand.

Thus, vessel 50 has a built-in straw 74 and means (channel 78) to prevent spillage of liquid during use of straw 74. Moreover, vessel 50, as is the case with vessel 10, is compact, simple to make and use, durable, inexpensive, compact, novel and of improved convenience. Both vessels can be made of any suitable components, such as metal, glass (except for spring 90), plastic, wood, cellulosic materials, etc. Various other features are as set forth in the foregoing.

Various modifications, changes, alterations and additions can be made in the present device and in its components and parameters. All such modifications, changes, alterations and additions as are within the scope of the appended claims form part of the present invention.

What is claimed is:

1. An improved drinking vessel comprising a container and an integrally associated drinking straw combination; said container having a flat bottom lying in a horizontal plane, a top extending on an arcuate plane, and a generally cylindrical mid-section having a reduced portion intermediate said top and bottom, a lip portion extending inwardly from and entirely around the top of said container and lying in the same plane as said top, a handle located at one side of said container and formed integrally therewith, said handle having an upper portion projecting upwardly and outwardly from the upper end of said side of the container, and a generally vertically extending portion integral at its upper end with said upper portion, said extending portion of said handle being laterally displaced from said side of the container during most of its length to form a finger receiving cavity, said extending portion of said handle having its lower end terminating at and integral with said bottom of the container, a straw comprising a first and second channel terminating into a common channel, said first channel being formed within the lower portion of the extending portion of the handle and serves to connect the bottom of the container's interior with said common channel, said second channel being formed within said upper portion of said handle and serves to connect the top of the container's interior with said common channel, said common channel being formed in the upper portion of the extending portion of said handle and terminating at the upper lateral tip thereof, whereby the contents of the container can be simultaneously drawn through both channels into said common channel.

2. The improved drinking vessel of claim 1 including valve means located within one of said channels to selectively control the egress of the contents of the container.

3. The improved drinking vessel of claim 2 including means to bias said valve means in a normally closed position.

* * * * *